US009742063B2

(12) United States Patent
Tao et al.

(10) Patent No.: US 9,742,063 B2
(45) Date of Patent: Aug. 22, 2017

(54) EXTERNAL LTE MULTI-FREQUENCY BAND ANTENNA

(71) Applicant: ARCADYAN TECHNOLOGY CORPORATION, Hsinchu (TW)

(72) Inventors: Wen-Szu Tao, Hsinchu (TW); Shin-Lung Kuo, Hsinchu (TW); Yi-Cheng Lin, Hsinchu (TW); Po-Hsun Wei, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 237 days.

(21) Appl. No.: 14/536,629

(22) Filed: Nov. 9, 2014

(65) Prior Publication Data

US 2015/0364821 A1 Dec. 17, 2015

Related U.S. Application Data

(60) Provisional application No. 62/012,108, filed on Jun. 13, 2014.

(30) Foreign Application Priority Data

Jul. 11, 2014 (TW) ..... 103124037 A

(51) Int. Cl.
*H01Q 5/307* (2015.01)
*H01Q 1/48* (2006.01)
(Continued)

(52) U.S. Cl.
CPC ..... *H01Q 5/307* (2015.01); *H01Q 1/38* (2013.01); *H01Q 1/48* (2013.01); *H01Q 5/378* (2015.01);
(Continued)

(58) Field of Classification Search
None
See application file for complete search history.

(56) References Cited

U.S. PATENT DOCUMENTS 5,835,063 A 11/1998 Brachat et al.
2007/0146214 A1 6/2007 Yuba et al.
(Continued)

FOREIGN PATENT DOCUMENTS

EP 2065972 A1 6/2009
TW 201017990 A 5/2010
TW 201205958 A 2/2012

OTHER PUBLICATIONS

European Search Report for counterpart European Patent Application No. 14195091.5.
(Continued)

*Primary Examiner* — Robert Karacsony
(74) *Attorney, Agent, or Firm* — The PL Law Group, PLLC

(57) ABSTRACT

An antenna is provided. The antenna includes a substrate having a first end and a second end opposite to the first end, wherein a direction from the first end to the second end is an extending direction of the antenna; a radiating portion; a feed-in conductor; and a ground portion electrically connected to the radiating portion, coupled to the feed-in conductor, disposed on the substrate from the first end along the extending direction, and including a main ground conductor; and a high frequency band bandwidth adjusting conductor extended from the main ground conductor along the extending direction.

13 Claims, 14 Drawing Sheets

(51) Int. Cl.

| | |
|---|---|
| ***H01Q 5/378*** | (2015.01) |
| ***H01Q 1/38*** | (2006.01) |
| ***H01Q 9/42*** | (2006.01) |
| *H01Q 1/24* | (2006.01) |
| *H01Q 1/08* | (2006.01) |

(52) U.S. Cl.
CPC ..... *H01Q 9/42* (2013.01); *H01Q 1/084* (2013.01); *H01Q 1/242* (2013.01); *Y10T 29/4902* (2015.01); *Y10T 29/49018* (2015.01)

(56) References Cited

U.S. PATENT DOCUMENTS

| | | | | |
|---|---|---|---|---|
| 2009/0079647 | A1 | 3/2009 | Jung et al. | |
| 2009/0256765 | A1 | 10/2009 | Lu et al. | |
| 2010/0090926 | A1 | 4/2010 | Li | |
| 2012/0098721 | A1* | 4/2012 | Wong ..... | H01Q 1/243 343/749 |

OTHER PUBLICATIONS

Office action issued on Jan. 19, 2016 from the TW Patent Office in a counterpart Taiwan Patent Application No. 103124037.
Patent Search Report from the TW Patent Office in a counterpart Taiwan Patent Application No. 103124037.

* cited by examiner

EXTERNAL LTE MULTI-FREQUENCY BAND ANTENNA

CROSS-REFERENCE TO RELATED APPLICATION AND CLAIM OF PRIORITY

The application claims the benefits of the U.S. Patent Application No. 62/012,108 filed on Jun. 13, 2014 in the USPTO, and the Taiwan Patent Application No. 103124037 filed on Jul. 11, 2014 in the Taiwan Intellectual Property Office, the disclosures of which are incorporated herein in their entirety by reference.

FIELD OF THE INVENTION

The present invention relates to an antenna and a manufacturing method thereof, and more particularly to an external LTE multi-frequency band antenna and a manufacturing method thereof.

BACKGROUND OF THE INVENTION

Nowadays, antennas with various sizes are developed to be applied to various hand-held electronic devices or wireless transmitting devices, e.g. the access point (AP). For example, the single-frequency band (2.4 GHz) of the inverse-F antenna (IFA), which can be easily disposed on the inner wall of the hand-held electronic device, is already in widespread existence. Due to the requirement of the user for the voice, image, multimedia communication service quality and transmission speed, the more advanced wireless communication technology, e.g. the 4G long term evolution (LTE), is applied to the hand-held electronic device which emphasizes the lightness, flimsiness and miniaturization. Therefore, the antenna also has to be capable of being used in the multi-frequency band of the LTE system, from the low frequency (690-960 MHz) to the high frequency (2.3-2.5 GHz), and possess a good transmission ability. The conventional antenna which can be applied to the multi-frequency band system has a complex structure or a large size.

In order to overcome the drawbacks in the prior art, an external LTE multi-frequency band antenna is provided. The particular design in the present invention not only solves the problems described above, but also is easy to be implemented. Thus, the present invention has the utility for the industry.

SUMMARY OF THE INVENTION

In accordance with an aspect of the present invention, an antenna is provided. The antenna includes a substrate including a first surface and a second surface opposite to the first surface; a ground portion disposed on the first surface, and including a main ground conductor and a high frequency band bandwidth adjusting conductor extended from the main ground conductor, wherein the main ground conductor has a grounding terminal; a J-shaped radiating portion disposed on the first surface, and including a first grounding conductor having a first length and a first width, and extended from the grounding terminal; a second grounding conductor having a second length and extended from the first grounding conductor along a first direction, wherein a first angle is formed between the first grounding conductor and the second grounding conductor; and a radiating conductor having a third length and a second width, and extended from the second grounding conductor along a second direction, wherein a second angle is formed between the second grounding conductor and the radiating conductor; and an L-shaped feed-in conductor disposed on the second surface, wherein a capacitive coupling is formed between the L-shaped feed-in conductor and the J-shaped radiating portion; the first length is larger than the third length; the third length is larger than the second length; and the second width is larger than the second length.

In accordance with another aspect of the present invention, an antenna is provided. The antenna includes an antenna body, including a substrate including a first surface and a second surface opposite to the first surface; a ground portion disposed on the first surface, and including a main ground conductor and a strip conductor extended from the main ground conductor; a first grounding conductor disposed on the first surface, extended from the main ground conductor, and parallel to the strip conductor; a second grounding conductor disposed on the first surface, and extended from the first grounding conductor along a first direction, wherein a first angle is formed between the first grounding conductor and the second grounding conductor; a radiating conductor disposed on the first surface, and extended from the second grounding conductor along a second direction, wherein a second angle is formed between the second grounding conductor and the radiating conductor; a feed-in terminal disposed on the second surface; and a coaxial cable having a symmetric axis and coupling the antenna to a circuit board, wherein the antenna is rotatable with respect to the symmetric axis in one of a clockwise direction and a counterclockwise direction, the feed-in terminal is electrically connected to a signal portion of the circuit board via the coaxial cable, and the ground conductor is electrically connected to a ground portion of the circuit board via the coaxial cable.

In accordance with a further aspect of the present invention, a method of manufacturing an antenna is provided. The method includes steps of providing a substrate, wherein the substrate includes a first surface and a second surface opposite to the first surface; forming a ground portion and a J-shaped radiating portion extended from the ground portion on the first surface; and forming an L-shaped feed-in conductor on the second surface.

In accordance with further another aspect of the present invention, an antenna is provided. The antenna includes a substrate having a first end and a second end opposite to the first end, wherein a direction from the first end to the second end is an extending direction of the antenna; a radiating portion; a feed-in conductor; and a ground portion electrically connected to the radiating portion, coupled to the feed-in conductor, disposed on the substrate from the first end along the extending direction, and including a main ground conductor; and a high frequency band bandwidth adjusting conductor extended from the main ground conductor along the extending direction.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
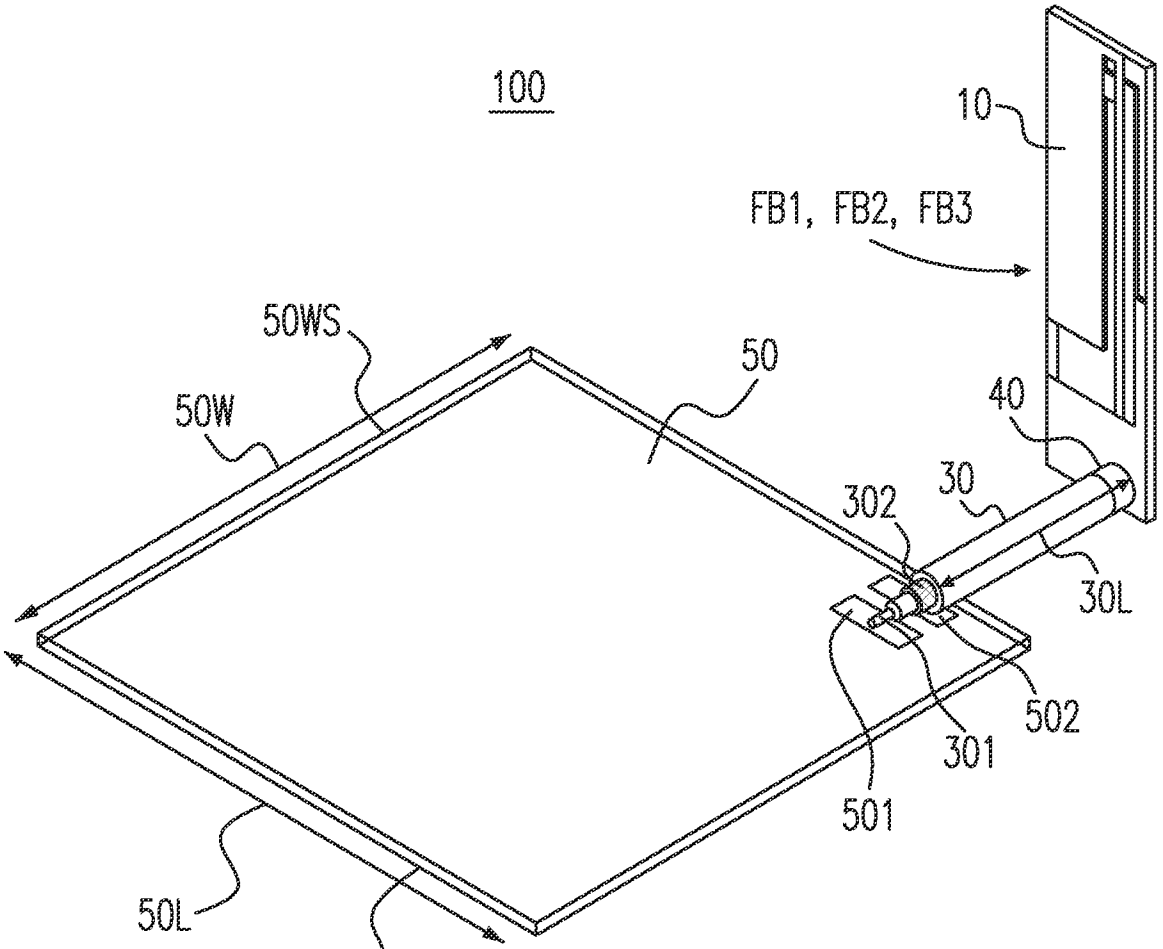
FIG. 1 shows an antenna system according to an embodiment of the present invention.
Figure 2:
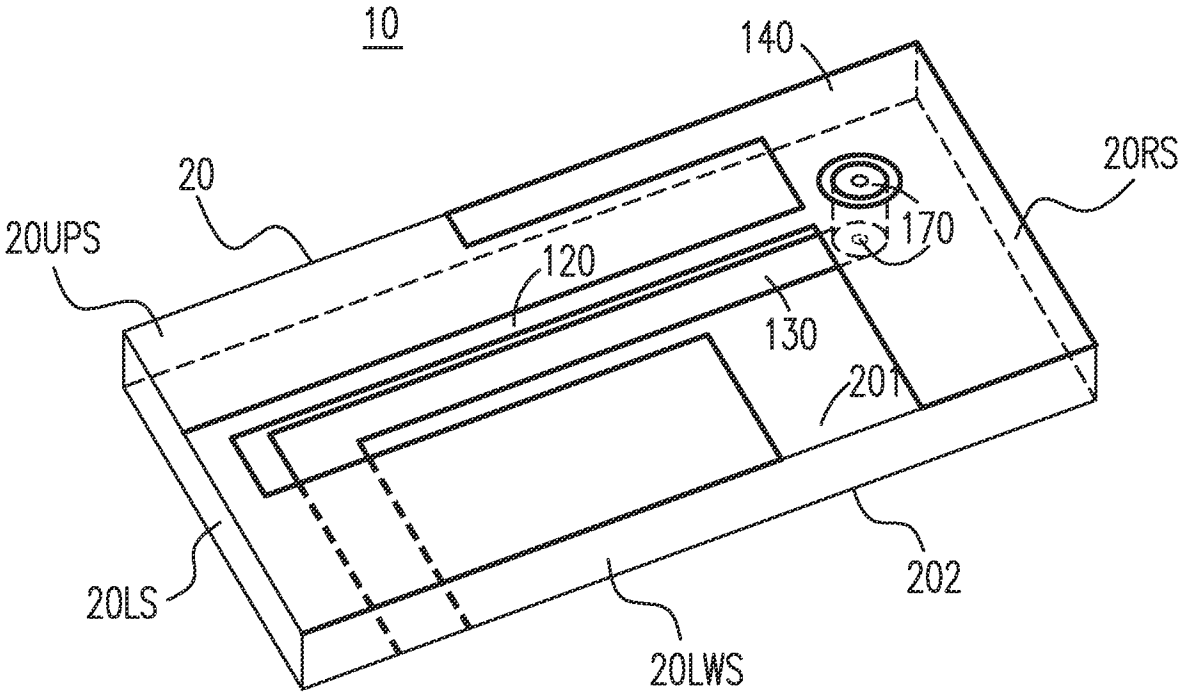
FIG. 2 shows an antenna according to an embodiment of the present invention.

Please refer to FIGS. 1 and 2. FIG. 1 shows an antenna system 100 according to an embodiment of the present invention, and FIG. 2 shows an antenna 10 according to an embodiment of the present invention. As shown in FIG. 1, the antenna system 100 includes the antenna 10 and a system circuit board 50 electrically connected to the antenna 10. The antenna 10 is connected to the system circuit board 50 via a coaxial cable 30 and a rotary connector 40, wherein the coaxial cable 30 has a length, a central conductor 301 and a shielded conductor 302. An end of the central conductor 301 is electrically connected to a system signal region 501 of the system circuit board 50, and another end of the central conductor 301 is electrically connected to a signal feed-in point 170 of the antenna 10. An end of the shielded conductor 302 is electrically connected to a system ground region 502 of the system circuit board 50, and another end of the shielded conductor 302 is electrically connected to a ground portion 140 of the antenna 10. The characteristic impedance of the coaxial cable 30 is 50Ω.

According to an embodiment of the present invention, the distance 30L between the system circuit board 50 and the antenna 10 is the sum of the length of the coaxial cable 30 and the length of the rotary connector 40, which is 10-50 mm. This causes the antenna to have an operating bandwidth of a low frequency band FB3. The system circuit board 50 further includes a long edge 50LS and a wide edge 50WS. The long edge 50LS has a length 50L, and the wide edge 50WS has a width 50W. The long edge 50LS is perpendicular to the axis of the coaxial cable 30, and the wide edge 50WS is parallel to the axis of the coaxial cable 30. According to an embodiment of the present invention, setting the length 50L to be larger than 40 mm causes the antenna 10 to have a suitable impedance matching for an intermediate frequency band FB2 and a suitable impedance matching for a high frequency band FB1, and setting the width 50W to be larger than 60 mm causes the antenna 10 to have a suitable operating bandwidth for the low frequency band FB3.

Please refer to FIG. 2. The antenna 10 includes an antenna body 11 and a substrate 20. According to an embodiment of the present invention, the antenna body 11 is a metal conductor structure manufactured on the substrate 20. The substrate 20 includes a first surface 201 and a second surface 202 opposite to the first surface 201. The metal conductor structure includes a first portion and a second portion, wherein the first portion is disposed on the first surface 201, and the second portion is disposed on the second surface 202. The first portion includes a ground portion 140 and a J-shaped radiating portion 120. The second portion includes a feed-in terminal 170 and an L-shaped feed-in conductor 130. The antenna 10 further includes a first substrate edge 20RS, a second substrate edge 20UPS, a third substrate edge 20LS and a fourth substrate edge 20LWS.

Figure 3A:
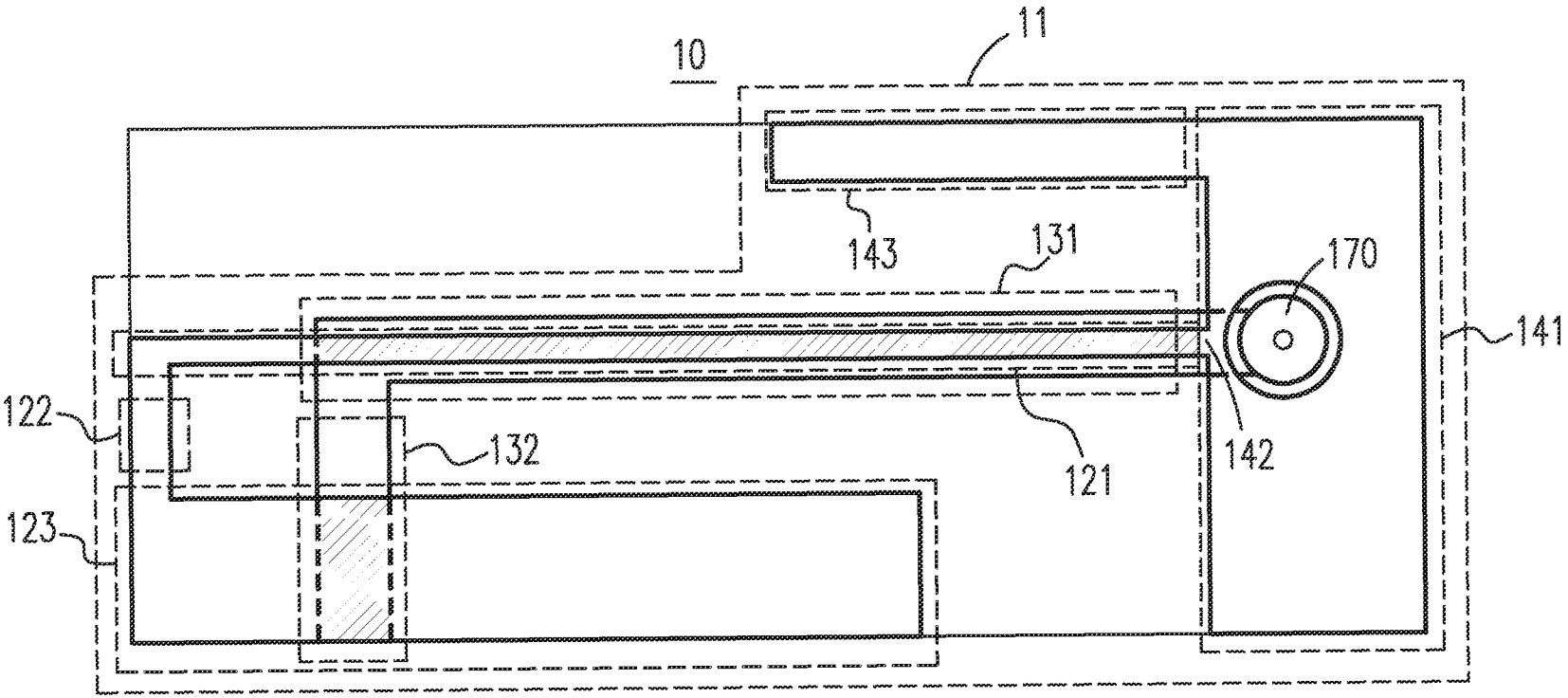
FIGS. 3A-3C show the antenna of FIG. 2 in different aspects.
Figure 3B:
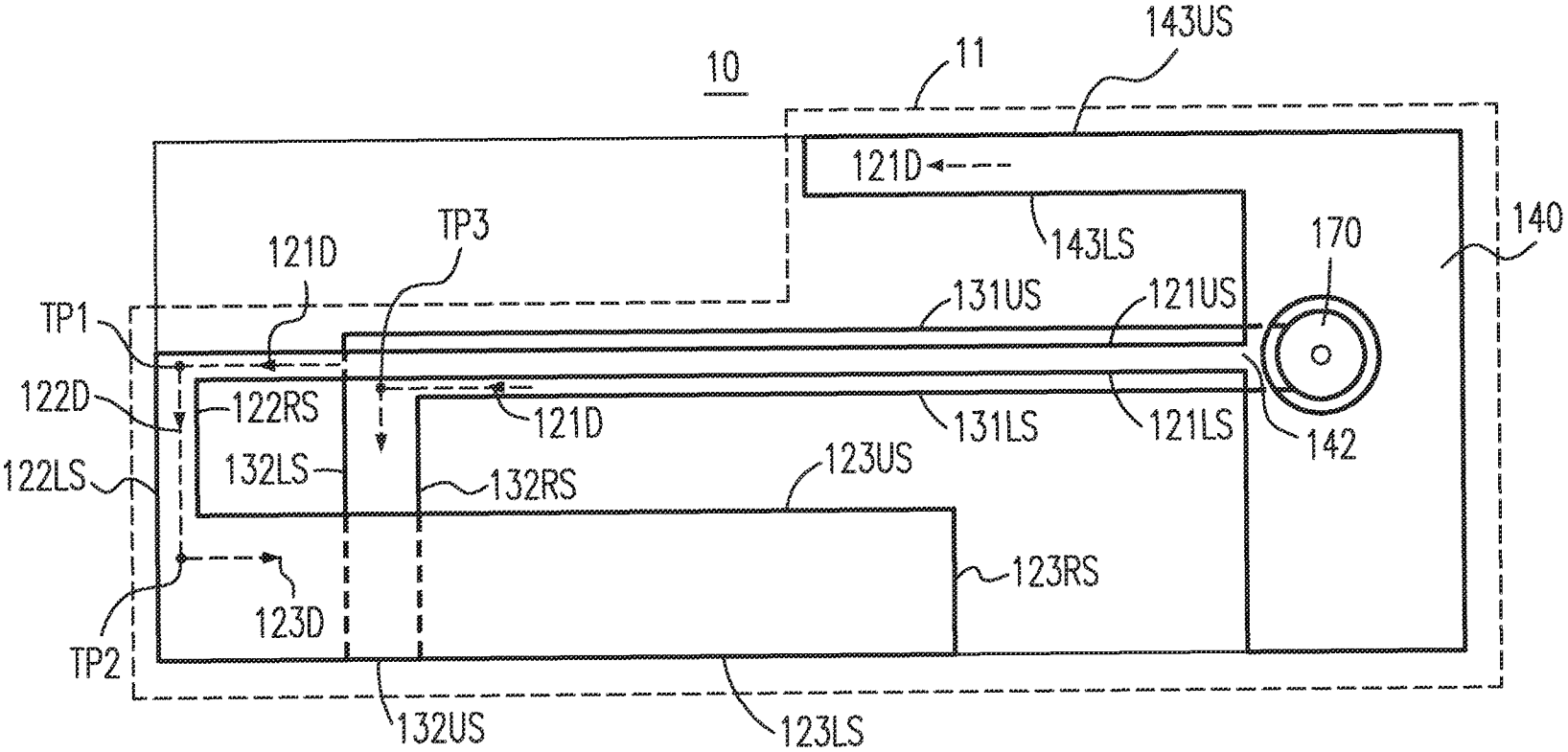
Figure 3C:
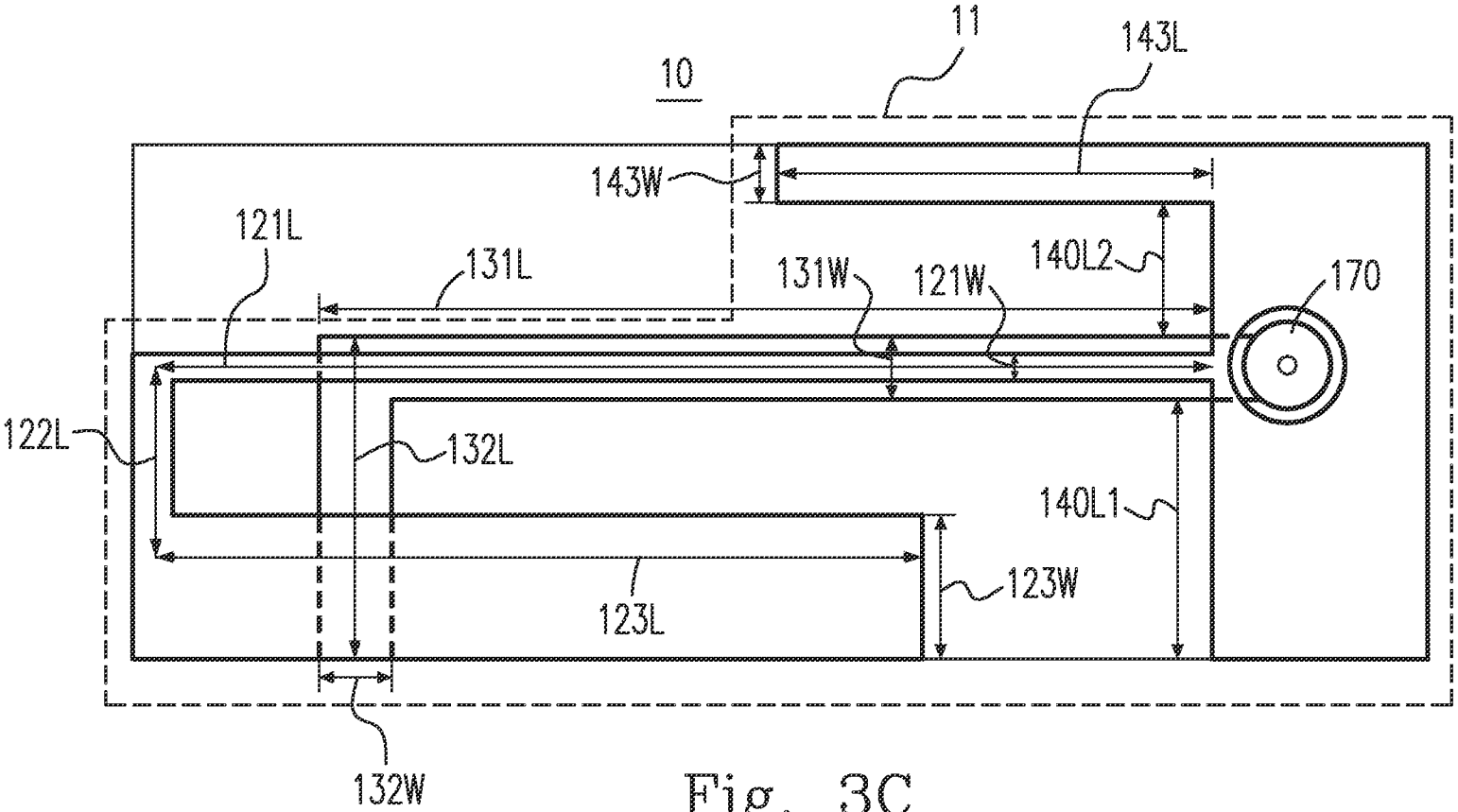

Please refer to FIGS. 3A-3C, which show the antenna 10 of FIG. 2 in different aspects. The antenna 10 includes the antenna body 11. The antenna body 11 includes the ground portion 140 and the J-shaped radiating portion 120 extended from the ground portion 140. The ground portion 140 is disposed on the first surface 201. The J-shaped radiating portion 120 is extended from a grounding terminal 142 in the middle of the edge of the ground portion 140. The J-shaped radiating portion 120 includes a first grounding conductor 121, a second grounding conductor 122 and a radiating conductor 123. The first grounding conductor 121 is extended from the grounding terminal 142 to a first corner TP1 along a first direction 121D. The second grounding conductor 122 is extended from the first corner TP1 to a second corner TP2 along a second direction 122D. The radiating conductor 123 is extended from the second corner TP2 along a third direction 123D, and forms a rectangular conductor. The first direction 121D is opposite to the third direction 123D. The first grounding conductor 121 has a first length 121L and a first width 121W. The second grounding conductor 122 has a second length 122L. The radiating conductor 123 has a third length 123L and a third width 123W. The J-shaped radiating portion 120 facilitates the setting for the impedance matching of the antenna body 11.

The first grounding conductor 121 includes a first edge 121US and a second edge 121LS parallel to the first edge 121US. The second grounding conductor 122 includes a third edge 122LS extended from the first edge 121US, and a fourth edge 122RS extended from the second edge 121LS. The third edge 122LS is parallel to the fourth edge 122RS, and overlaps the third substrate edge 20LS. The radiating conductor 123 includes a fifth edge 123US extended from the fourth edge 122RS, a sixth edge 123LS extended from the third edge 122LS, and a seventh edge 123RS disposed between the fifth edge 123US and the sixth edge 123LS. The fifth edge 123US is parallel to the sixth edge 123LS, and the sixth edge 123LS overlaps the fourth edge 20LW.

The antenna body 11 further includes a high frequency band bandwidth adjusting conductor 143, which is a strip conductor. The high frequency band bandwidth adjusting conductor 143 is disposed on the first surface 201, and extended from the lateral portion of the ground portion 140 along a first direction 121D. The high frequency band bandwidth adjusting conductor 143 further includes a thirteenth edge 143US and a fourteenth edge 143LS parallel to the thirteenth edge 143US. The fourteenth edge 143LS overlaps the second substrate edge 20UP. The high frequency band bandwidth adjusting conductor 143 has a sixth length 143L and a fifth width 143W. The high frequency band bandwidth adjusting conductor 143 facilitates the setting for the bandwidth of the antenna body 11 operating within the second operating frequency band FB2 and the third operating frequency band FB3.

The antenna body 11 further includes the feed-in terminal 170 and the L-shaped feed-in conductor 130 extended from the feed-in terminal 170. The feed-in terminal 170 is disposed on the first surface 201. The L-shaped feed-in conductor 130 is extended on the second surface 202 from the feed-in terminal 170. The L-shaped feed-in conductor 130 includes a first feed-in conductor 131 and a second feed-in conductor 132 extended from the first feed-in conductor 131. The first feed-in conductor 131 is extended from the feed-in terminal 170 to a third corner TP3 along a first direction 121D. The second feed-in conductor 132 is extended from the third corner TP1 to the edge of the substrate 20 along a second direction 122D, and forms a rectangular conductor. The first feed-in conductor 131 has a fourth length 131L and a second width 131W. The second feed-in conductor 132 has a fifth length 132L and a fourth width 132W.

The first feed-in conductor 131 is parallel to the first grounding conductor 121, overlaps, when projected, but free from contacting the first grounding conductor 121 to generate the electromagnetic coupling. Similarly, the rear portion of the second feed-in conductor 132 overlaps, when projected, but free from contacting the radiating conductor 123 to generate the electromagnetic coupling. The effect of these electromagnetic coupling reduces the area of the antenna 10.

The first feed-in conductor 131 includes an eighth edge 131US and a ninth edge 131LS parallel to the eighth edge 131US, wherein the eighth edge 131US is parallel to the first edge 121US. The second feed-in conductor 132 includes a tenth edge 132LS extended from the eighth edge 131US, an eleventh edge 132RS extended from the ninth edge 131LS, and a twelfth edge 132US. The tenth edge 132LS is parallel to the eleventh edge 132RS, and the twelfth edge 132US overlaps the second substrate edge 20LW.

In order to cause the antenna body 11 to have the required operating parameters, e.g. the frequency band, bandwidth and impedance matching, a plurality of geometric parameters of the antenna body 11 are set. For example, the first length 121L is set to be larger than the third length 123L, the third length 123L is set to be larger than the second length 122L, the second width 123W is set to be larger than the second length 122L, the first length 121L is set to be larger than the fourth length 131L, and the third width 131W is set to be larger than the first width 121W.

In the manufacturing process of the antenna 10, usually the antenna 10 has a predetermined size according to the application requirement of the electronic device. Then, the size of a manufacturing mold is obtained by using the computer simulation according to the predetermined size, and a plurality of antenna parameters are set in the meantime. The antenna parameters include an operating frequency, an operating bandwidth and an impedance matching. The desired antenna is manufactured by the mold.

According to the third length 123L being approximately a quarter of the resonance wavelength of the first operating frequency band FB1, the first operating frequency band FB1 of the antenna 10 is determined. According to the sum of the third length 123L and the second length 122L being approximately a quarter of the resonance wavelength of the second operating frequency band FB2, the second operating frequency band FB2 of the antenna 10 is determined by the sum of the third length 123L and the second length 122L. According to the sum of the third length 123L, the second length 122L and the first length 121L being approximately a quarter of the resonance wavelength of the third operating frequency band FB3, the third operating frequency band FB3 of the antenna 10 is determined.

The first operating frequency band FB1, the second operating frequency band FB2 and the third operating frequency band FB3 of the antenna 10 are within the range of the frequency band of the 4G LTE. The first operating frequency band FB1 is ranged from 2.3-2.4 GHz, the second operating frequency band FB2 is ranged from 1.71-2.17 GHz, and the third operating frequency band FB3 is ranged from 690-960 MHz.

After the first operating frequency band FB1, the second operating frequency band FB2 and the third operating frequency band FB3 are set, the third length 123L can be adjusted to a proper length according to the third operating frequency band FB3 so as to adjust the bandwidth of the third operating frequency band FB3 of the antenna 10. The third length 123L can be adjusted along the direction away from or toward the second corner TP2. In addition, the second width 123W can be adjusted to a proper width according to the second operating frequency band FB2 so as to adjust the impedance matching of the second operating frequency band FB2 of the antenna 10. The second width 123W can be adjusted along the direction away from or toward the first grounding conductor 121.

Afterward, the fourth width 132W can be adjusted to a proper width according to the third operating frequency band FB3 so as to further adjust the impedance matching of the third operating frequency band FB3 of the antenna 10. Similarly, the fourth width 132W can be adjusted to a proper width according to the second operating frequency band FB2 so as to further adjust the impedance matching of the second operating frequency band FB2 of the antenna 10. The fourth width 132W can be adjusted along the direction away from or toward the eleventh edge 132RS.

The sixth length 143L can be adjusted to a proper length according to the first operating frequency band FB1 so as to adjust the impedance matching of the first operating frequency band FB1 of the antenna 10.

Figure 4A:
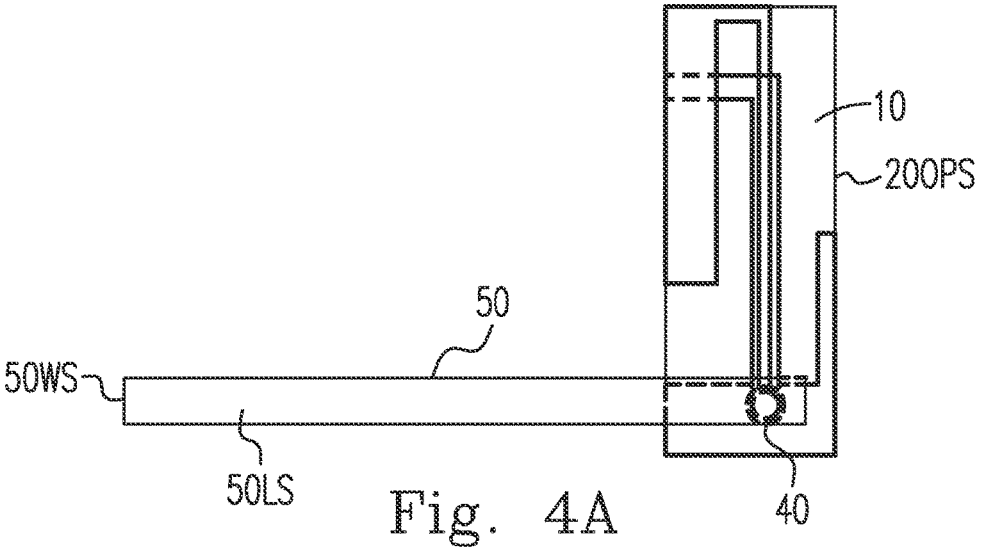
FIGS. 4A-4C show the antenna of FIG. 2 rotating with respect to a system circuit board.
Figure 4B:
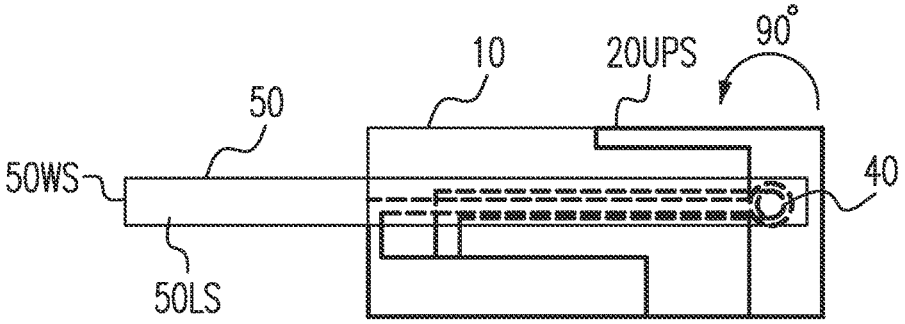
Figure 4C:
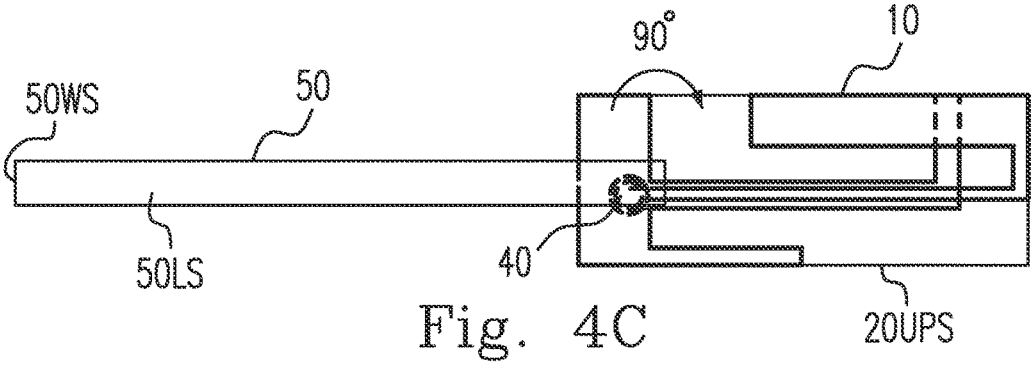

Please refer to FIGS. 1 and 4A-4C. FIGS. 4A-4C show the antenna 10 of FIG. 2 rotating with respect to the system circuit board 50. FIG. 4A shows that the first substrate edge 20UPS is perpendicular to the long edge 50LS of the system circuit board 50. FIG. 4B shows that the antenna 10 rotates with respect to the system circuit board 50 in a counterclockwise direction by 90 degrees. FIG. 4C shows that the antenna 10 rotates with respect to the system circuit board 50 in a clockwise direction by 90 degrees. According to an embodiment of the present invention, the antenna 10 can rotate with respect to the axis of the coaxial cable 30 at any angles according to the use environment to adjust the posture or orientation, thereby obtaining a better effect of wireless communication.

Figure 5:
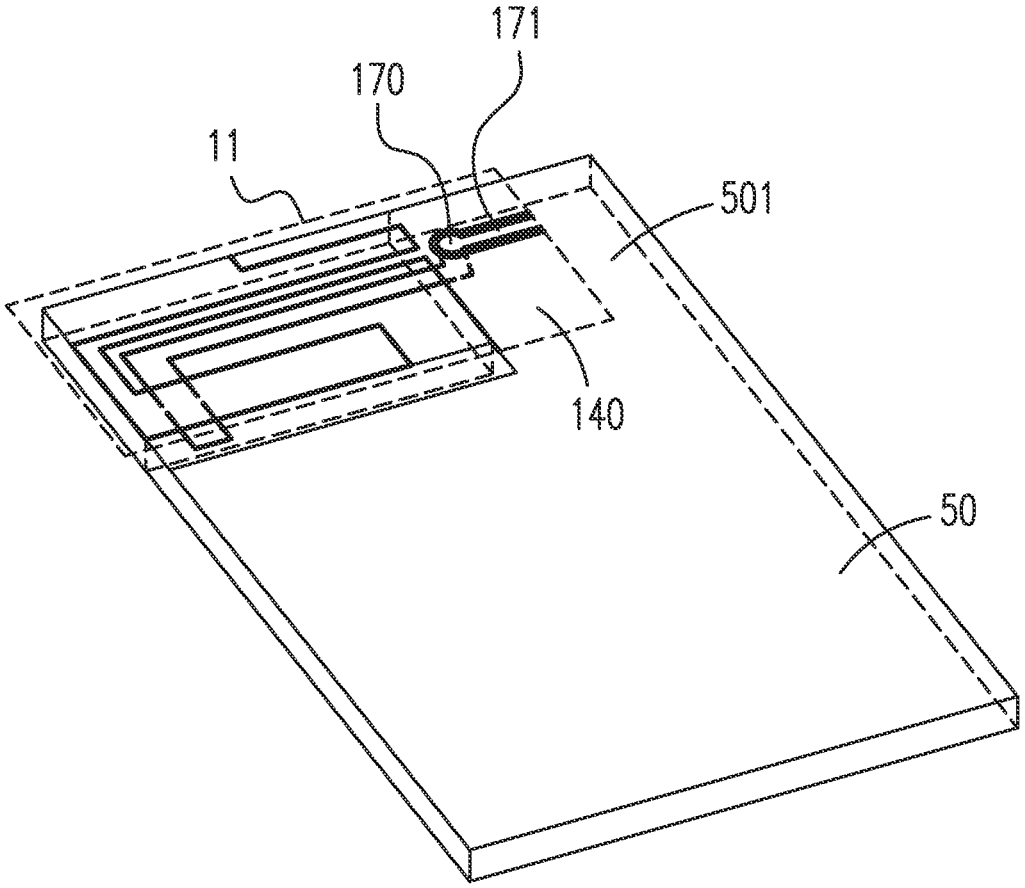
FIG. 5 shows the antenna of FIG. 2 manufactured on the system circuit board.

Please refer to FIG. 5, which shows the antenna 10 of FIG. 2 manufactured on the system circuit board 50. According to an embodiment of the present invention, the antenna body 11 also can be directly manufactured on the system circuit board 50 to become a part of the system circuit board 50. The ground portion 140 of the antenna body 11 is electrically connected to the ground portion 502 of the system circuit board 50. The feed-in terminal 170 of the antenna body 11 is extended to a feed-in signal line 171, and electrically connected to a radio frequency (RF) signal module (not shown) of the system circuit board 50.

Figure 6:
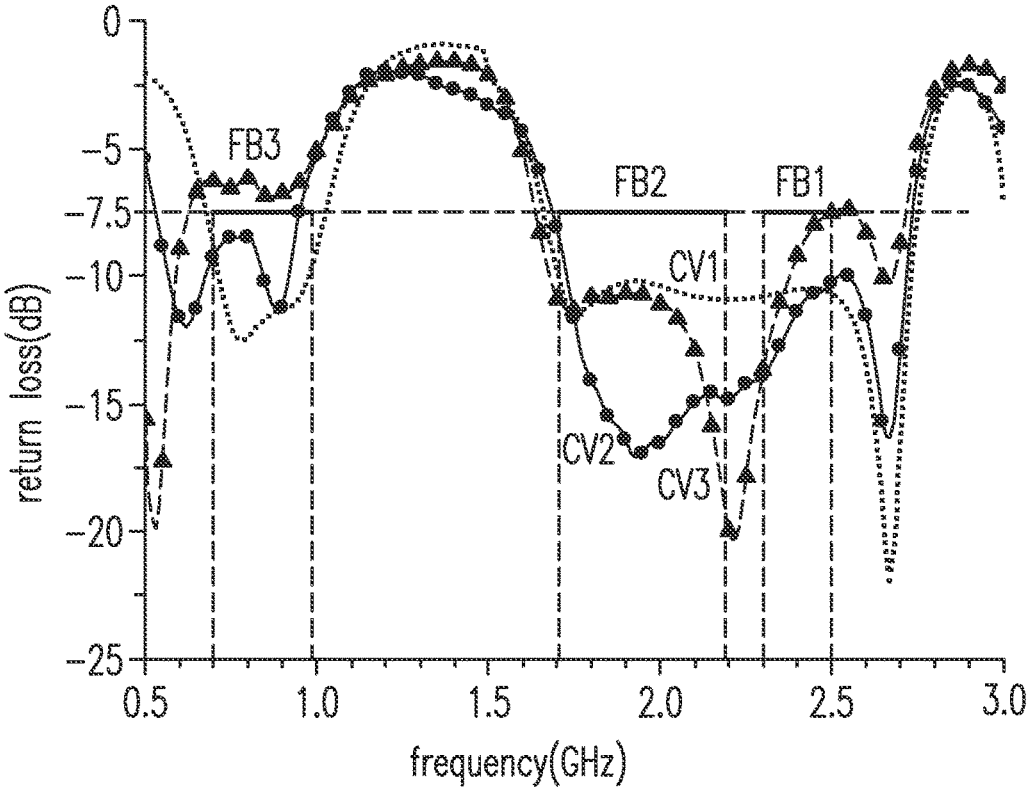
FIG. 6 shows the relationship between the return loss and the frequency with different distances between the antenna and the system circuit board.

Please refer to FIG. 6, which shows the relationship between the return loss and the frequency with different distances 30L between the antenna 10 and the system circuit board 50. As shown in FIG. 6, the curves CV1, CV2 and CV3 correspond to the distance 30L of 30 mm, the distance 30L of 40 mm and the distance 30L of 50 mm respectively. The return loss of the antenna 10 in the first operating frequency band FB1, the return loss of the antenna 10 in the second operating frequency band FB2 and the return loss of the antenna 10 in the third operating frequency band FB3 are all below the desired maximum value "−7.5 dB". The change of the distance 30L has a greater influence on the bandwidths of the first operating frequency band FB1 and the second operating frequency band FB2. According to an embodiment of the present invention, the distance 30L is set to be 10-50 mm.

Figure 7A:
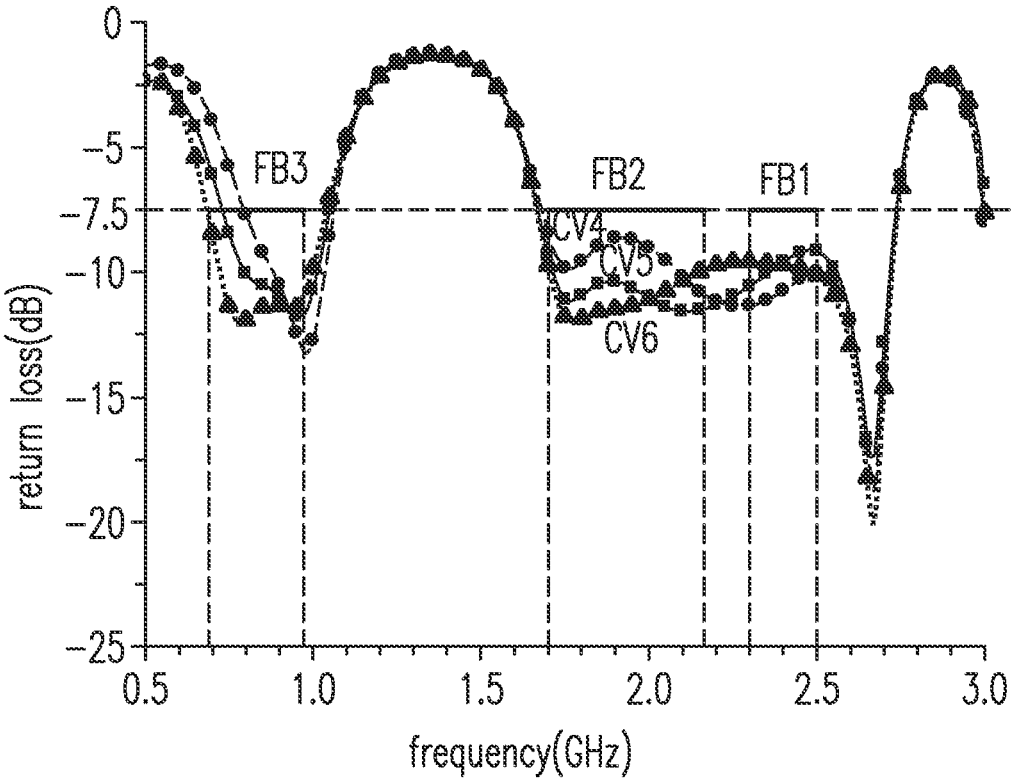
FIG. 7A shows the relationship between the return loss and the frequency with different widths of the system circuit board.

Please refer to FIG. 7A, which shows the relationship between the return loss and the frequency with different widths 50W of the system circuit board 50. As shown in FIG. 7A, the curves CV4, CV5 and CV6 correspond to the width 50W of 40 mm, the width 50W of 60 mm and the width 50W of 80 mm respectively. The return loss of the antenna 10 in the first operating frequency band FB1, the return loss of the antenna 10 in the second operating frequency band FB2 and the return loss of the antenna 10 in the third operating frequency band FB3 are all below the desired maximum value "−7.5 dB". The change of the width 50W has a greater influence on the bandwidth of the third operating frequency band FB3. According to an embodiment of the present invention, the width 50W is set to be larger than 60 mm.

Figure 7B:
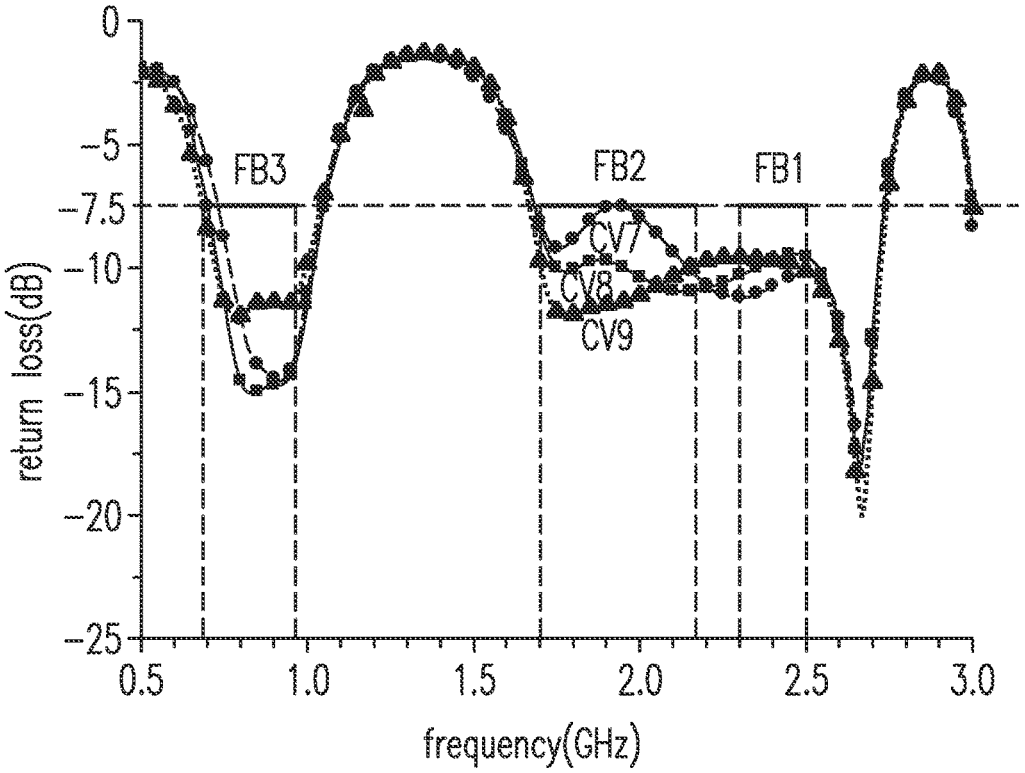
FIG. 7B shows the relationship between the return loss and the frequency with different lengths of the system circuit board.

Please refer to FIG. 7B, which shows the relationship between the return loss and the frequency with different lengths 50L of the system circuit board 50. As shown in FIG. 7B, the curves CV7, CV8 and CV9 correspond to the length 50L of 40 mm, the length 50L of 60 mm and the length 50L of 80 mm respectively. The return loss of the antenna 10 in the first operating frequency band FB1, the return loss of the antenna 10 in the second operating frequency band FB2 and the return loss of the antenna 10 in the third operating frequency band FB3 are all below the desired maximum value "−7.5 dB". The change of the length 50L has a greater influence on the impedance matching of the first operating frequency band FB1 and the impedance matching of the second operating frequency band FB2. According to an embodiment of the present invention, the length 50L is set to be larger than 40 mm.

Figure 8A:
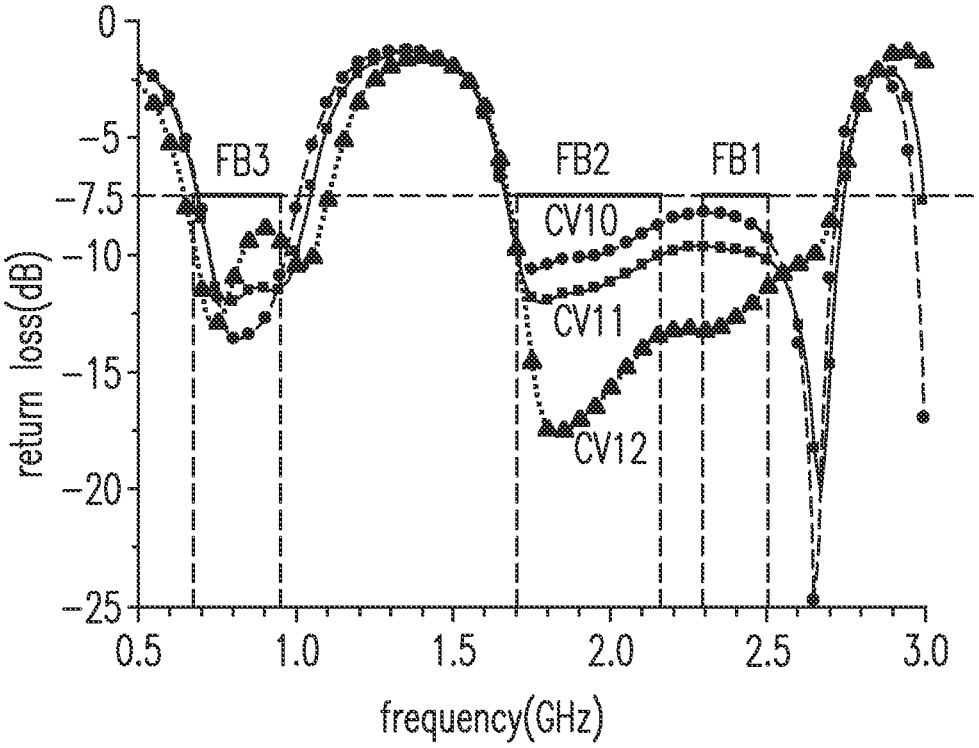
FIG. 8A shows the relationship between the return loss and the frequency with different third lengths of the radiating conductor.

Please refer to FIG. 8A, which shows the relationship between the return loss and the frequency with different third lengths 123L of the radiating conductor 123. As shown in FIG. 8A, the curves CV10, CV11 and CV12 correspond to the third length 123L of 55 mm, the third length 123L of 57 mm and the third length 123L of 57.5 mm respectively. The return loss of the antenna 10 in the first operating frequency band FB1, the return loss of the antenna 10 in the second operating frequency band FB2 and the return loss of the antenna 10 in the third operating frequency band FB3 are all below the desired maximum value "−7.5 dB". The change of the third length 123L has a greater influence on the bandwidth of the third operating frequency band FB3.

Figure 8B:
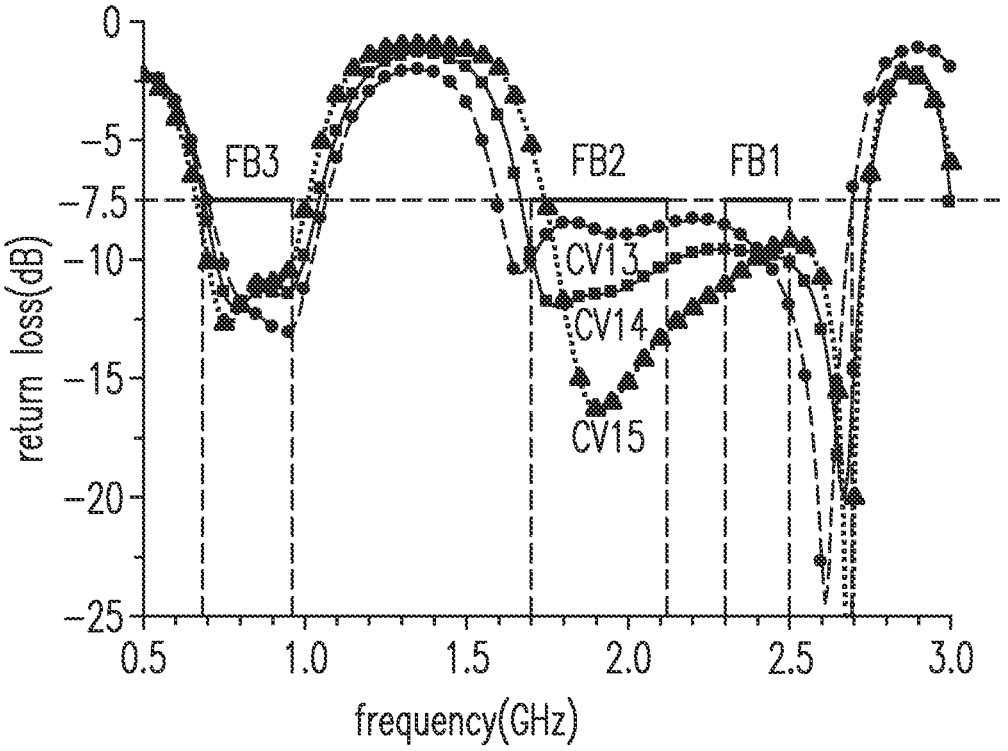
FIG. 8B shows the relationship between the return loss and the frequency with different second widths of the radiating conductor.

Please refer to FIG. 8B, which shows the relationship between the return loss and the frequency with different second widths 123W of the radiating conductor 123. As shown in FIG. 8B, the curves CV13, CV14 and CV15 correspond to the second width 123W of 10 mm, the second width 123W of 10.5 mm and the second width 123W of 10.8 mm respectively. The return loss of the antenna 10 in the first operating frequency band FB1, the return loss of the antenna 10 in the second operating frequency band FB2 and the return loss of the antenna 10 in the third operating frequency band FB3 are all below the desired maximum value "−7.5 dB". The change of the second width 123W has a greater influence on the impedance matching of the first operating frequency band FB1 and the impedance matching of the second operating frequency band FB2.

Figure 9:
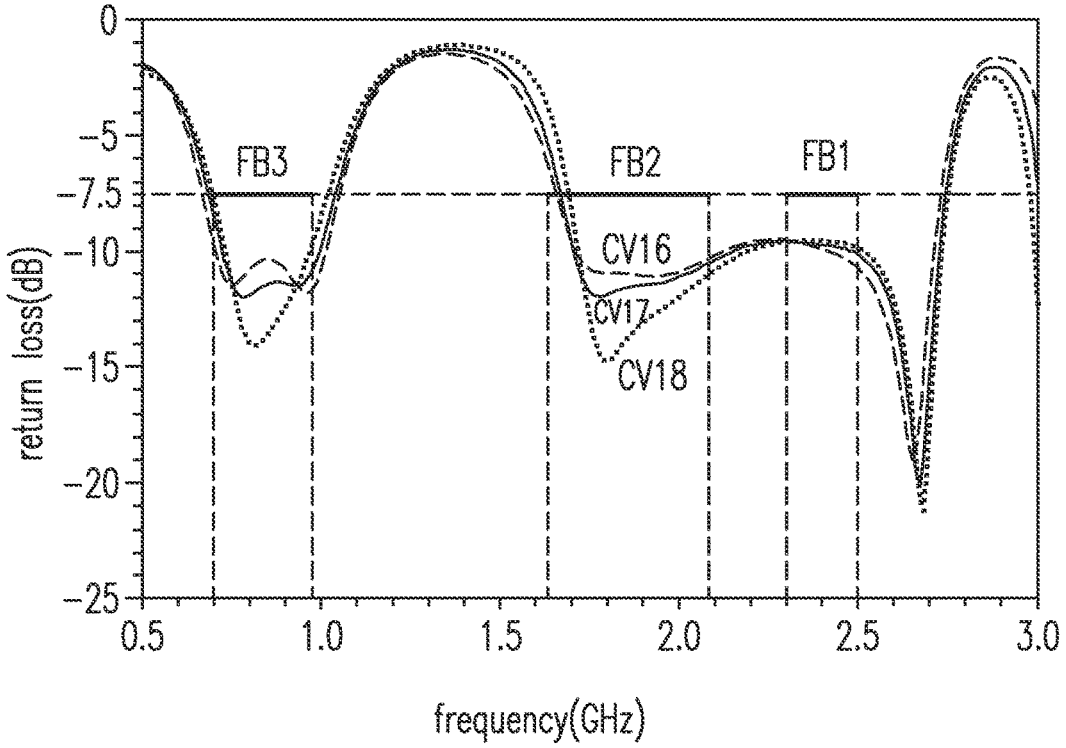
FIG. 9 shows the relationship between the return loss and the frequency with different fourth widths of the second feed-in conductor.

Please refer to FIG. 9, which shows the relationship between the return loss and the frequency with different fourth widths 132W of the second feed-in conductor 132. As shown in FIG. 9, the curves CV16, CV17 and CV18 correspond to the fourth width 132W of 2.5 mm, the fourth width 132W of 3.5 mm and the fourth width 132W of 4.5 mm respectively. The return loss of the antenna 10 in the first operating frequency band FB1, the return loss of the antenna 10 in the second operating frequency band FB2 and the return loss of the antenna 10 in the third operating frequency band FB3 are all below the desired maximum value "−7.5 dB". The change of the fourth width 132W has a greater influence on the impedance matching of the second operating frequency band FB2 and the impedance matching of the third operating frequency band FB3. According to an embodiment of the present invention, the fourth width 132W is set to be 3.5 mm.

Figure 10:
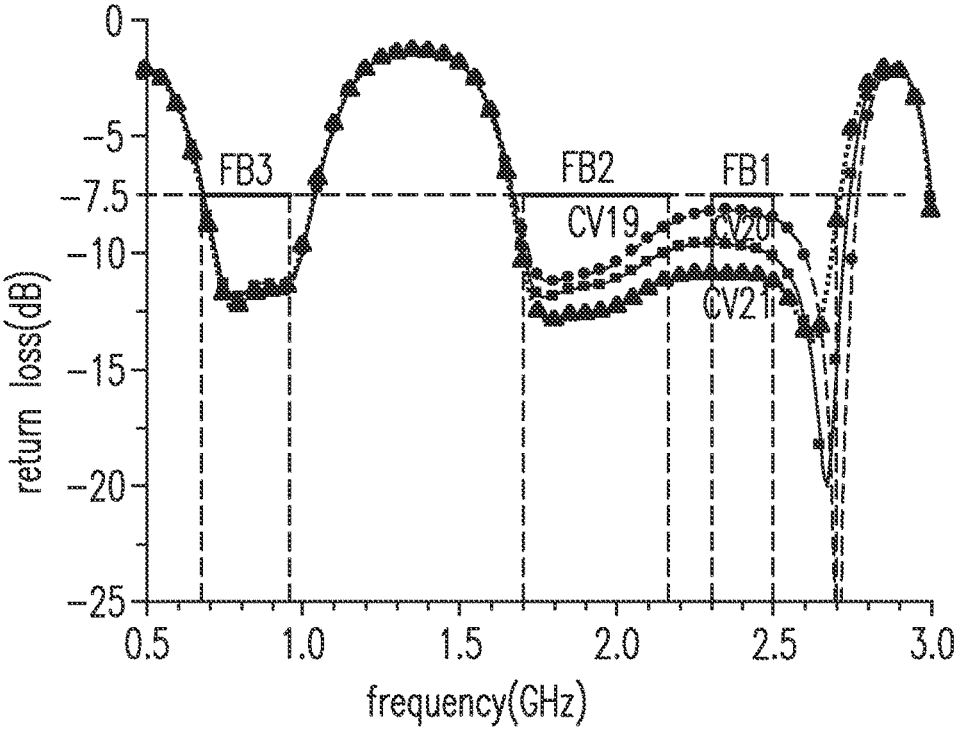
FIG. 10 shows the relationship between the return loss and the frequency with different sixth lengths of the high frequency band bandwidth adjusting conductor.

Please refer to FIG. 10, which shows the relationship between the return loss and the frequency with different sixth lengths 143L of the high frequency band bandwidth adjusting conductor 143. As shown in FIG. 10, the curves CV19, CV20 and CV21 correspond to the sixth length 143L of 19.6 mm, the sixth length 143L of 20.1 mm and the sixth length 143L of 20.6 mm respectively. The return loss of the antenna 10 in the first operating frequency band FB1, the return loss of the antenna 10 in the second operating frequency band FB2 and the return loss of the antenna 10 in the third operating frequency band FB3 are all below the desired maximum value "−7.5 dB". The change of the sixth length 143L has a greater influence on the impedance matching of the first operating frequency band FB1. According to an embodiment of the present invention, the sixth length 143L is set to be 20.1 mm.

EMBODIMENTS

1. An antenna, comprising a substrate including a first surface and a second surface opposite to the first surface; a ground portion disposed on the first surface, and including a main ground conductor and a high frequency band bandwidth adjusting conductor extended from the main ground conductor, wherein the main ground conductor has a grounding terminal; a J-shaped radiating portion disposed on the first surface, and including a first grounding conductor having a first length and a first width, and extended from the grounding terminal; a second grounding conductor having a second length and extended from the first grounding conductor along a first direction, wherein a first angle is formed between the first grounding conductor and the second grounding conductor; and a radiating conductor having a third length and a second width, and extended from the second grounding conductor along a second direction, wherein a second angle is formed between the second grounding conductor and the radiating conductor; and an L-shaped feed-in conductor disposed on the second surface, wherein a capacitive coupling is formed between the L-shaped feed-in conductor and the J-shaped radiating portion; the first length is larger than the third length; the third length is larger than the second length; and the second width is larger than the second length.

2. The antenna of Embodiment 1, wherein the third length determines a first operating frequency band of the antenna; and the first operating frequency band is ranged from 2.3-2.4 GHz.

3. The antenna of any one of Embodiments 1-2, wherein a first sum of the third length and the second length determines a second operating frequency band of the antenna; and the second operating frequency band is ranged from 1.71-2.17 GHz.

4. The antenna of any one of Embodiments 1-3, wherein a first impedance matching of the antenna operating within the second operating frequency band depends on the second width.

5. The antenna of any one of Embodiments 1-4, wherein a second sum of the third length, the second length and the first length determines a third operating frequency band of the antenna; and the third operating frequency band is ranged from 690-960 MHz.

6. The antenna of any one of Embodiments 1-5, wherein a first bandwidth of the third operating frequency band of the antenna depends on the third length.

7. The antenna of any one of Embodiments 1-6, wherein the first grounding conductor includes a first edge and a second edge parallel to the first edge.

8. The antenna of any one of Embodiments 1-7, wherein the second grounding conductor includes a third edge extended from the first edge and a fourth edge extended from the second edge, wherein the third edge is parallel to the fourth edge.

9. The antenna of any one of Embodiments 1-8, wherein the radiating conductor includes a fifth edge extended from the fourth edge, a sixth edge extended from the third edge, and a seventh edge disposed between the fifth edge and the sixth edge, wherein the fifth edge is parallel to the sixth edge.

10. The antenna of any one of Embodiments 1-9, wherein the antenna further includes a coaxial cable; the ground portion further includes a ground terminal; and the coaxial cable includes a central conductor and a shielded conductor surrounding the central conductor, wherein the central conductor is electrically connected to a feed-in terminal, and the shielded conductor is electrically connected between the ground terminal of the ground portion and a system ground terminal of a system circuit board.

11. The antenna of any one of Embodiments 1-10, wherein the L-shaped feed-in conductor includes a feed-in terminal; a first feed-in conductor having a fourth length and a third width, extended from the feed-in terminal, parallel to the first grounding conductor, and overlapping, when projected, but free from contacting the first grounding conductor; and a second feed-in conductor having a fifth length and a fourth width, extended from the first feed-in conductor along the second direction, and forming a first rectangular conductor, wherein a third angle is formed between the first feed-in conductor and the second feed-in conductor.

12. The antenna of any one of Embodiments 1-11, wherein the first length is larger than the fourth length; the third width is larger than the first width; a rear portion of the second feed-in conductor overlaps, when projected, but free from contacting the radiating conductor; a first gap is formed among the first feed-in conductor, the first grounding conductor, the second grounding conductor and the radiating conductor; and a second impedance matching depends on the third width.

13. The antenna of any one of Embodiments 1-12, wherein the first feed-in conductor includes an eighth edge and a ninth edge parallel to the eighth edge, wherein the eighth edge is parallel to the first edge; and the second feed-in conductor includes a tenth edge extended from the eighth edge, an eleventh edge extended from the ninth edge, and a twelfth edge disposed between the tenth edge and the eleventh edge and having a fourth width, wherein the tenth edge is parallel to the eleventh edge.

14. The antenna of any one of Embodiments 1-13, wherein the main ground conductor has an inner edge facing the seventh edge, wherein the inner edge has an intermediate portion and a lateral portion, and the grounding terminal is disposed at the intermediate portion; the high frequency band bandwidth adjusting conductor is a strip conductor, having a sixth length, extended from the lateral portion, and parallel to the first feed-in conductor; the strip conductor includes a thirteenth edge and a fourteenth edge parallel to the thirteenth edge; the main ground conductor forms a second rectangular conductor; the high frequency band bandwidth adjusting conductor forms a third rectangular conductor; the radiating conductor forms a fourth rectangular conductor; and the antenna has a relatively higher operating frequency band and a relatively lower operating frequency band, wherein the relatively higher operating frequency band has a second bandwidth depending on the sixth length.

15. An antenna, comprising an antenna body, including a substrate including a first surface and a second surface opposite to the first surface; a ground portion disposed on the first surface, and including a main ground conductor and a strip conductor extended from the main ground conductor; a first grounding conductor disposed on the first surface, extended from the main ground conductor, and parallel to the strip conductor; a second grounding conductor disposed on the first surface, and extended from the first grounding conductor along a first direction, wherein a first angle is formed between the first grounding conductor and the second grounding conductor; a radiating conductor disposed on the first surface, and extended from the second grounding conductor along a second direction, wherein a second angle is formed between the second grounding conductor and the radiating conductor; a feed-in terminal disposed on the second surface; and a coaxial cable having a symmetric axis and coupling the antenna to a circuit board, wherein the antenna is rotatable with respect to the symmetric axis in one of a clockwise direction and a counterclockwise direction, the feed-in terminal is electrically connected to a signal portion of the circuit board via the coaxial cable, and the ground conductor is electrically connected to a ground portion of the circuit board via the coaxial cable.

16. The antenna of Embodiment 15, further comprising a first feed-in conductor disposed on the second surface, extended from the feed-in terminal along a direction identical to an extending direction of the first short-circuit conductor, and including a front portion extended from a front portion of the feed-in terminal and a rear portion extended from the front portion, wherein the rear portion overlaps, when projected, but free from contacting the first grounding conductor; and a second feed-in conductor disposed on the second surface, extended from the first feed-in conductor along a third direction, forming a first rectangular conductor, and overlapping, when projected, but free from contacting the radiating conductor, wherein the radiating conductor forms a second rectangular conductor.

17. A method of manufacturing an antenna, comprising steps of providing a substrate, wherein the substrate includes a first surface and a second surface opposite to the first surface; forming a ground portion and a J-shaped radiating portion extended from the ground portion on the first surface; and forming an L-shaped feed-in conductor on the second surface.

18. The method of Embodiment 17, wherein the method further includes steps of providing a coaxial cable having a first length, wherein the coaxial cable includes a central conductor and a shielded conductor surrounding the central conductor; and disposing the coaxial cable on the ground portion by electrically connecting the central conductor and the shielded conductor to the L-shaped feed-in conductor and the ground portion, respectively; the ground portion includes a main ground conductor and a strip conductor extended from the main ground conductor, wherein the main ground conductor has a grounding terminal, and the strip conductor has a second length; the J-shaped radiating portion is extended from the grounding terminal; the coaxial cable has a reference axis; the L-shaped feed-in conductor has a feed-in terminal for receiving the central conductor, and forms a capacitive coupling with the J-shaped radiating portion via the substrate; and the antenna has a relatively higher operating frequency band and a relatively lower operating frequency band.

19. The method of Embodiment 18, further comprising steps of adjusting the second length to cause the relatively higher operating frequency band to have a predetermined bandwidth; providing a system circuit board, wherein the system circuit board includes a system ground terminal and a lateral side; disposing the coaxial cable on the lateral side by electrically connecting the shielded conductor to the system ground terminal to couple the antenna to the system circuit board, and cause the substrate to have an orientation with respect to the system circuit board; causing the substrate to rotate around the reference axis by an angle to adjust the orientation; and adjusting the first length to determine an impedance matching of the relatively lower operating frequency band.

20. An antenna, comprising a substrate having a first end and a second end opposite to the first end, wherein a direction from the first end to the second end is an extending direction of the antenna; a radiating portion; a feed-in conductor; and a ground portion electrically connected to the radiating portion, coupled to the feed-in conductor, disposed on the substrate from the first end along the extending direction, and including a main ground conductor; and a high frequency band bandwidth adjusting conductor extended from the main ground conductor along the extending direction.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna, comprising:

a substrate including a first surface and a second surface opposite to the first surface;

a ground portion disposed on the first surface, and including a main ground conductor and a high frequency band bandwidth adjusting conductor extended from the main ground conductor, wherein the main ground conductor has a grounding terminal;

a J-shaped radiating portion disposed on the first surface, and including:

a first grounding conductor having a first length and a first width, and extended from the grounding terminal;

a second grounding conductor having a second length and extended from the first grounding conductor along a first direction, wherein a first angle is formed between the first grounding conductor and the second grounding conductor; and a radiating conductor having a third length and a second width, and extended from the second grounding conductor along a second direction, wherein a second angle is formed between the second grounding conductor and the radiating conductor; and an L-shaped feed-in conductor disposed on the second surface including:

a feed-in terminal;

a first feed-in conductor having a fourth length and a third width, extended from the feed-in terminal, parallel to the first grounding conductor, and overlapping, when projected, but free from contacting the first grounding conductor; and a second feed-in conductor having a fifth length and a fourth width, extended from the first feed-in conductor along the second direction, and forming a first rectangular conductor, wherein a third angle is formed between the first feed-in conductor and the second feed-in conductor;

a capacitive coupling is formed between the L-shaped feed-in conductor and the J-shaped radiating portion;

the first length is larger than the third length;

the third length is larger than the second length; and the second width is larger than the second length.

2. The antenna as claimed in claim 1, wherein:

the third length determines a first operating frequency band of the antenna; and the first operating frequency band is ranged from 2.3-2.4 GHz.

3. The antenna as claimed in claim 1, wherein:

a first sum of the third length and the second length determines a second operating frequency band of the antenna; and the second operating frequency band is ranged from 1.71-2.17 GHz.

4. The antenna as claimed in claim 3, wherein a first impedance matching of the antenna operating within the second operating frequency band depends on the second width.

5. The antenna as claimed in claim 1, wherein:

a second sum of the third length, the second length and the first length determines a third operating frequency band of the antenna; and the third operating frequency band is ranged from 690-960 MHz.

6. The antenna as claimed in claim 5, wherein a first bandwidth of the third operating frequency band of the antenna depends on the third length.

7. The antenna as claimed in claim 1, wherein the first grounding conductor includes a first edge and a second edge parallel to the first edge.

8. The antenna as claimed in claim 7, wherein the second grounding conductor includes a third edge extended from the first edge and a fourth edge extended from the second edge, wherein the third edge is parallel to the fourth edge.

9. The antenna as claimed in claim 8, wherein the radiating conductor includes a fifth edge extended from the fourth edge, a sixth edge extended from the third edge, and a seventh edge disposed between the fifth edge and the sixth edge, wherein the fifth edge is parallel to the sixth edge.

10. The antenna as claimed in claim 1, wherein:

the antenna further includes a coaxial cable;

the ground portion further includes a ground terminal; and the coaxial cable includes a central conductor and a shielded conductor surrounding the central conductor, wherein the central conductor is electrically connected to a feed-in terminal, and the shielded conductor is electrically connected between the ground terminal of the ground portion and a system ground terminal of a system circuit board.

11. The antenna as claimed in claim 1, wherein:

the first length is larger than the fourth length;

the third width is larger than the first width;

a rear portion of the second feed-in conductor overlaps, when projected, but free from contacting the radiating conductor;

a first gap is formed among the first feed-in conductor, the first grounding conductor, the second grounding conductor and the radiating conductor; and a second impedance matching depends on the third width.

12. The antenna as claimed in claim 11, wherein:

the first feed-in conductor includes an eighth edge and a ninth edge parallel to the eighth edge, wherein the eighth edge is parallel to the first edge; and the second feed-in conductor includes a tenth edge extended from the eighth edge, an eleventh edge extended from the ninth edge, and a twelfth edge disposed between the tenth edge and the eleventh edge and having a fourth width, wherein the tenth edge is parallel to the eleventh edge.

13. The antenna as claimed in claim 11, wherein:

the main ground conductor has an inner edge facing the seventh edge, wherein the inner edge has an intermediate portion and a lateral portion, and the grounding terminal is disposed at the intermediate portion;

the high frequency band bandwidth adjusting conductor is a strip conductor, having a sixth length, extended from the lateral portion, and parallel to the first feed-in conductor;

the strip conductor includes a thirteenth edge and a fourteenth edge parallel to the thirteenth edge;

the main ground conductor forms a second rectangular conductor;

the high frequency band bandwidth adjusting conductor forms a third rectangular conductor;

the radiating conductor forms a fourth rectangular conductor; and the antenna has a relatively higher operating frequency band and a relatively lower operating frequency band, wherein the relatively higher operating frequency band has a second bandwidth depending on the sixth length.

* * * * *